US010603553B2

(12) United States Patent
Miller et al.

(10) Patent No.: US 10,603,553 B2
(45) Date of Patent: Mar. 31, 2020

(54) GOLF BALL RETRIEVAL DEVICE

(71) Applicant: Glenn Francis Miller, Melbourne, FL (US)

(72) Inventors: Glenn Francis Miller, Melbourne, FL (US); Charles Barnett, Melbourne, FL (US)

(73) Assignee: KOOL KART LLC, Melbourne, FL (US)

( * ) Notice: Subject to any disclaimer, the term of this patent is extended or adjusted under 35 U.S.C. 154(b) by 0 days.

(21) Appl. No.: 16/235,846

(22) Filed: Dec. 28, 2018

(65) Prior Publication Data

US 2019/0201750 A1 Jul. 4, 2019

Related U.S. Application Data

(60) Provisional application No. 62/611,669, filed on Dec. 29, 2017.

(51) Int. Cl.
*A63B 47/02* (2006.01)

(52) U.S. Cl.
CPC ..... *A63B 47/02* (2013.01)

(58) Field of Classification Search
CPC ..... A63B 47/02
USPC ..... 294/19.2, 179; 56/400.11, 400.21; 473/386
See application file for complete search history.

(56) References Cited

U.S. PATENT DOCUMENTS 1,095,585 A * 5/1914 MacK ..... A01D 46/24 294/179
2,864,228 A * 12/1958 Griffith, Jr. ..... A01D 11/00 294/176
3,360,650 A * 12/1967 Lawrence ..... G03B 27/16 250/205
3,437,368 A * 4/1969 Anderson ..... A63B 47/02 294/19.2
3,979,890 A * 9/1976 Schenk ..... A01D 51/002 56/328.1
4,254,981 A * 3/1981 Wilson ..... A63B 47/02 294/19.2
4,828,690 A * 5/1989 Montez ..... B07B 1/02 209/418
5,246,260 A * 9/1993 Racicot ..... A63B 47/02 294/179
D362,038 S * 9/1995 Schatz ..... D21/721
5,482,338 A * 1/1996 Hall ..... A63B 47/02 294/19.2

(Continued)

*Primary Examiner* — Paul T Chin
(74) *Attorney, Agent, or Firm* — Mark C. Johnson; Johnson | Dalal

(57) ABSTRACT

A golf ball retrieval device is disclosed that includes a plurality of claws are disposed adjacent to one another and aligned in a first direction, each of the plurality of claws including a coupling portion to which at least one pivot member is fixed; a plurality of elongated rigid link members extend transversely between two or more of the plurality of claws and are arranged to pivot on two or more of the pivot members, in which the plurality of claws are movable relative to one another between a collapsed configuration and an expanded configuration; and a locking mechanism configured to secure the plurality of claws in the collapsed configuration when the locking mechanism in a first position, and to secure the plurality of claws in the expanded configuration when the locking mechanism is in a second position.

15 Claims, 9 Drawing Sheets

(56) References Cited

U.S. PATENT DOCUMENTS

| | | | | | |
|---|---|---|---|---|---|
| 5,590,924 | A | * | 1/1997 | Quinn | A63B 47/02<br>294/19.2 |
| 5,662,366 | A | * | 9/1997 | Fraske | A63B 47/02<br>294/19.2 |
| 5,743,578 | A | * | 4/1998 | Schuermann | A63B 47/02<br>294/19.2 |

* cited by examiner

GOLF BALL RETRIEVAL DEVICE

CROSS-REFERENCE TO RELATED APPLICATION

This Application claims benefit to U.S. Provisional Application No. 62/611,669 filed on Dec. 29, 2017.

BACKGROUND

The present disclosure generally relates to golf, and more particularly, to a golf ball retrieval device.

Golfers may hit an errant shot in which the golf ball lands in difficult to retrieve areas, such as water hazards, bushes and the like. Current golf ball retrieval devices include an elongated pole and a cup at the end. However, these retrieval devices may only allow a user to retrieve one ball at a time. Moreover, a user may find the current golf ball retrieval devices to be cumbersome and difficult to operate.

SUMMARY

In one or more scenarios, the disclosed technology relates to A ball retrieval device, the device comprising: a plurality of claws disposed adjacent to one another and aligned in a first direction, each of the plurality of claws including a coupling portion to which at least one pivot member is fixed; a plurality of elongated rigid link members, each extending transversely between two or more of the plurality of claws and arranged to pivot on two or more of the pivot members, whereby the plurality of claws are movable relative to one another between a collapsed configuration and an expanded configuration; and a locking mechanism which is movable between at least a first position and a second position, the locking mechanism configured to secure the plurality of claws in the collapsed configuration when the locking mechanism in the first position, and to secure the plurality of claws in the expanded configuration when the locking mechanism is in the second position; wherein the plurality of claws in the collapsed configuration are spaced apart from each other by a first distance, and in the expanded configuration are spaced apart from each other a second distance which is greater than the first distance.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description.

DETAILED DESCRIPTION

Figure 1:
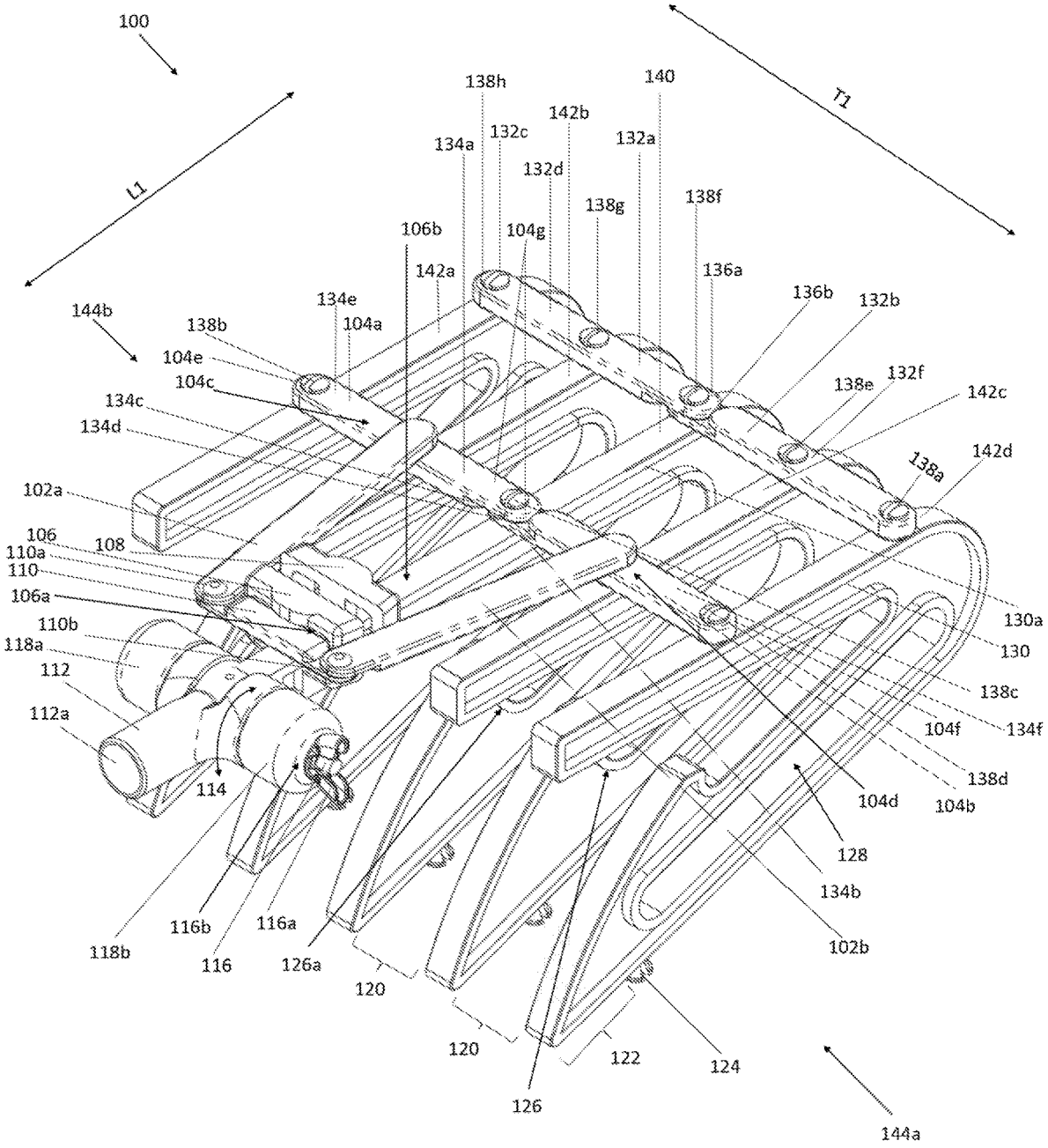
FIG. 1 illustrates an isometric view of a first example of a golf ball retrieval device in an open position.

The following discussion omits or only briefly describes conventional features of golf ball retrieval devices, which are apparent to those skilled in the art. It is noted that various embodiments are described in detail with reference to the drawings, in which like reference numerals represent like parts and assemblies throughout the several views. Reference to various embodiments does not limit the scope of the claims attached hereto. Additionally, any examples set forth in this specification are intended to be non-limiting and merely set forth some of the many possible embodiments for the appended claims. Further, particular features described herein can be used in combination with other described features in each of the various possible combinations and permutations.

Unless otherwise specifically defined herein, all terms are to be given their broadest possible interpretation including meanings implied from the specification as well as meanings understood by those skilled in the art and/or as defined in dictionaries, treatises, etc. It must also be noted that, as used in the specification and the appended claims, the singular forms "a," "an" and "the" include plural referents unless otherwise specified, and that the terms "comprises" and/or "comprising," when used in this specification, specify the presence of stated features, elements, and/or components, but do not preclude the presence or addition of one or more other features, steps, operations, elements, components, and/or groups thereof.

Embodiments of the present disclosure relate generally to golf, and more particularly, to a golf ball retrieval device. Embodiments of the golf ball retrieval device are described below with reference to FIGS. 1-7.

Figure 3A:
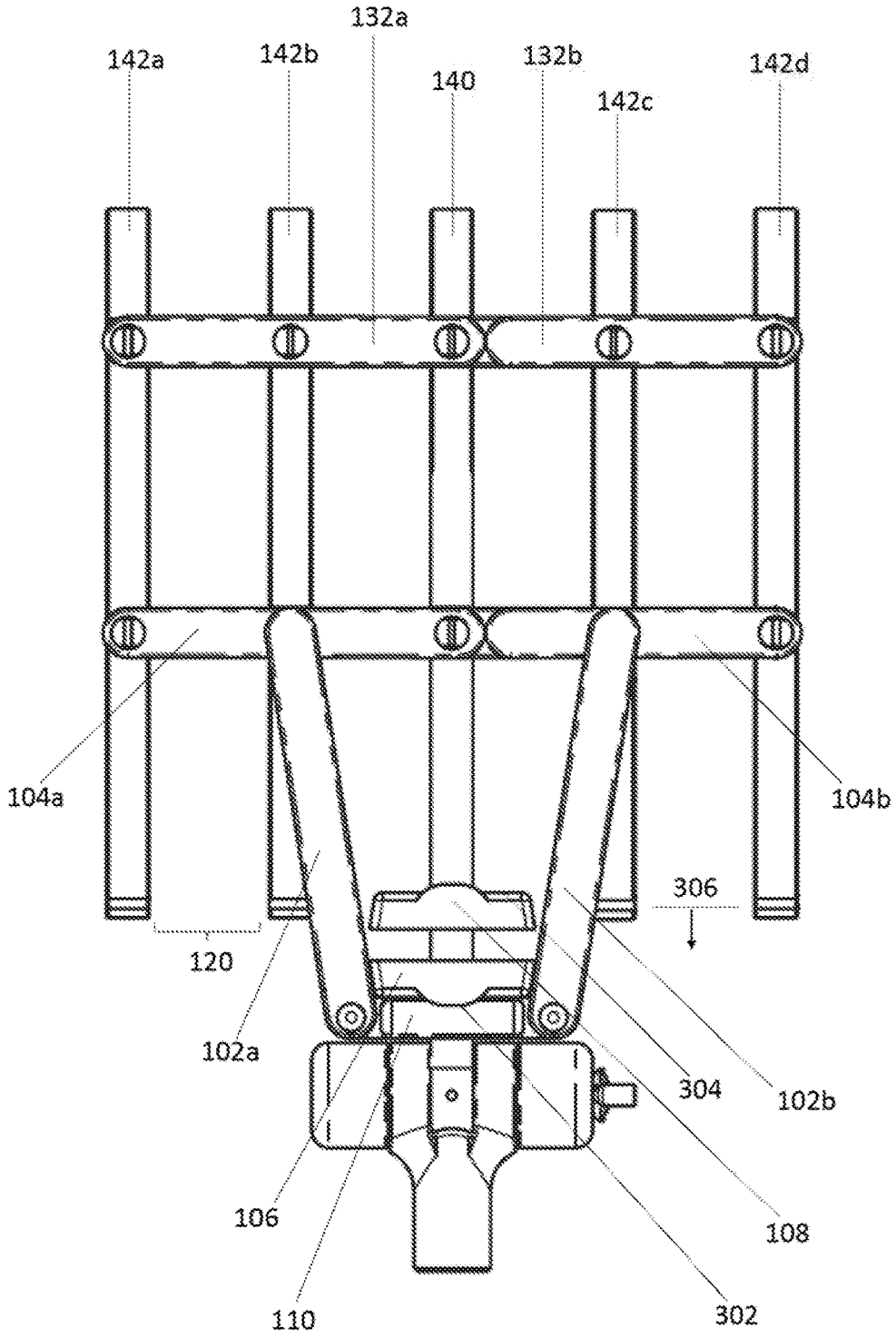
FIG. 3A illustrates a top view of the golf ball retrieval device in an open position.

FIG. 1 illustrates an isometric view of a first example of a golf ball retrieval device 100 (hereinafter "device 100") in an open position. FIG. 3A illustrates a top view of the device 100 in an open position.

The device 100 includes a handle mechanism, a locking mechanism, and a retrieval mechanism.

The handle mechanism may include a handle receiver 112*a* configured to receive and fasten an elongated tubular handle such as a rake handle, to the device 100. In one or more embodiments, the handle mechanism may include a folding joint 112 configured to rotate 114 about one or more tensioner portions, such as tensioner portion 118*a* and tensioner portion 118*b*. The tensioner portions 118*a* and 118*b* may each be cylindrical tubular disc like members that may be positioned on opposite sides of the folding joint 112. The tensioner portions 118*a* and 118*b* may be configured to hold the folding joint 112 in a position that can be set by a user. The tensioner portions 118*a* and 118*b* may each receive a portion of a tensioner 116. The tensioner 116 may pass through the tensioner portion 118*b* and the folding joint 112 and fasten to a portion tensioner portion 118*a*. The portion of the tensioner portion 118*a* configured to receive and fasten to the tensioner 116 may be threaded to correspond to a threaded end of the tensioner 116. The tensioner portions 118*a* and 118*b* may be compressed towards one another or decompressed away from one another by tightening or loosening a tensioning handle 116*a* on a portion 116*b* of the tensioner 116. The tensioning handle 116*a* may be a type of knob, handle, nut, such as a wing nut, or other type of tensioning handle known to one of ordinary skill in the art. For example, a user may decompress the tensioner portions 118*a* and 118*b* by rotating the tensioning handle 116*a*, such as a wing nut, in a counterclockwise direction. Having reduced the compression on the tensioner portions 118*a* and 118*b*, the user may set the folding joint 112 in a rotation position, for example in a direction parallel with the pivot link support portion 130, and tighten the tensioning handle 116*a* in a clockwise direction in order to compress the tensioner portions 118*a* and 118*b* and hold the folding joint 112 in the position set by the user. In one or more scenarios, the pivot link support portion 130 is an elongated rigid structure integrally formed with a claw.

In one or more scenarios, the locking mechanism may include an open position locking portion 106, a closed position locking portion 108, and a key portion 110 coupled to at least two pivot links, such as the first pivot link 102*a* and the second pivot link 102*b*. The open position locking portion 106 and the closed position locking portion 108 may be elongated rigid structures coupled to the central claw 140. The key portion 110 is a cross-member extending in the transverse direction T1 of the device 100. The key portion 110 may be an elongated rigid structure having a first end 110*a* opposed to a second end 110*b*. For the instances in which the device 100 is configured in the open position, the key portion 110 is configured to interlock with the open position locking portion 106. For the instances in which the device 100 is configured in the closed position, the key portion 110 is configured to interlock with the closed position locking portion 108. In one or more scenarios, the first end 110*a* of the key portion 110 is pivotably coupled to an end of the first pivot link 102*a*, and the second end 110*b* of the key portion 110 is pivotably coupled to an end of the second pivot link 102*b*.

In one or more scenarios, first pivot joint link 102*a*, the second pivot joint link 102*b*, the third pivot joint link 104*a*, and the fourth pivot joint link 104*b* are rigid elongated link structures. The first pivot link 102*a* and the second pivot link 102*b* are pivotably coupled to a third pivot link 104*a* and a fourth pivot link 104*b*, respectively. The first pivot link 102*a* and the second pivot link 102*b* are each coupled to intermediate portions 104*c* and 104*d* of the third pivot link 104*a* and the fourth pivot link 104*b*, respectively. The intermediation portions 104*c* and 104*d* of the third pivot joint link 104*a* and the fourth pivot joint link 104*b* may each be disposed between two ends of the third pivot joint link 104*a* and the fourth pivot joint link 104*b*, respectively.

For the instances in which the device 100 is configured in the open position, the third pivot link 104*a* and the fourth pivot link 104*b* extend in the transverse direction T1 of the device 100. The distal end 104*e* of the third pivot link 104*a* may be pivotably coupled to the outer claw 142*a*. The distal end 104*f* of the fourth pivot link 104*b* may be pivotably coupled to the outer claw 142*d*. The proximal ends 104*g* of the third pivot link 104*a* and the fourth pivot link 104*b* may each include a pivot link coupling portion, such as pivot link coupling portion 134*a* and pivot link coupling portion 134*b*. The pivot link coupling portions 134*a* and 134*b* may each be notched forming notched ends 134*c* and 134*d*. The pivot link coupling portion 134*a* and the pivot link coupling portion 134*b* may be configured to rest on one another such that the top surface 134*e* of the third pivot link 104*a* and the top surface 134*f* of the fourth pivot link 104*b* lie on the same plane. A pivot member, such as pivot member 138, may be used to pivotably couple the third pivot link 104*a* and the fourth pivot link 104*b* at the pivot link coupling portions 134*a* and 134*b* and to the central claw 140.

In one or more scenarios, a fifth pivot link 132*a* and a sixth pivot link 132*b* are rigid elongated link structures. The fifth pivot link 132*a* and the sixth pivot link 132*b* are pivotably coupled to one another. The fifth pivot link 132*a* is pivotably coupled to at least one of the outer claw 142*a*, the inner claw 142*b*, and the central claw 140. The distal end 132*c* of the fifth pivot link 132*a* may be pivotably coupled to the outer claw 142*a*. The intermediate portion 132*d* of the fifth pivot link 132*a* may be pivotably coupled to the inner claw 142*b*. The sixth pivot link 132*b* is pivotably coupled to at least one of the outer claw 142*d*, the inner claw 142*c*, and the central claw 140. The distal end 132*e* of the sixth pivot link 132*b* may be pivotably coupled to the outer claw 142*d*. The intermediate portion 132*f* of the sixth pivot link 132*b* may be pivotably coupled to the inner claw 142*c*. The intermediate portions 132*d* and 132*f* may each be disposed between two ends of the fifth pivot link 132*a* and the sixth pivot link 132*b*, respectively.

For the instances in which the device 100 is configured in the open position, the fifth pivot link 132*a* and the sixth pivot link 132*b* extend in the transverse direction T1 of the device 100. The proximal ends of the fifth pivot link 132*a* and the sixth pivot link 132*b* may each include a pivot link coupling portion, such as pivot link coupling portion 136*a* and pivot link coupling portion 136*b*. The pivot link coupling portion 136*a* and the pivot link coupling portion 136*b* may each be notched forming notched ends. The pivot link coupling portion 136*a* and the pivot link coupling portion 136*b* may be configured to rest on one another such that the top surfaces of the fifth pivot link 132*a* and the sixth pivot link 132*b* lie on the same plane. A pivot member, such as pivot member 138, may be used to pivotably couple the fifth pivot link 132*a* and the sixth pivot link 132*b* at the pivot link coupling portions and to the central claw 140.

In one or more scenarios, the underside of each claw may include one or more additional support portions 124. The additional support portions 124 may be configured to receive additional pivot links, in which an additional pivot link is configured to be pivotably coupled to at least two claws in a similar manner as described with respect to the third pivot link 104*a*, fourth pivot link 104*b*, fifth pivot link 132*a*, and/or sixth pivot link 132*b*.

In one or more scenarios, a pivot member 138*b* may pivotably couple the third pivot joint link 104*a* to the outer claw 142*a*. In one or more scenarios, the pivot member 138*f* may pivotably couple the fifth pivot link 132*a* to the outer claw 142*a*. In one or more scenarios, the pivot member 138*b* may pivotably couple the fifth pivot link 132*a* to the inner claw 142*b*. In one or more scenarios, the pivot member 138*f* may pivotably couple the fifth pivot link 132*a*, and/or sixth pivot link 132*b* to the central claw 140. In one or more scenarios, the pivot member 138*c* may pivotably couple the third pivot joint link 104*a*, and/or fourth pivot joint link 104*b* to the central claw 140. In one or more scenarios, the pivot member 138*e* may pivotably couple the sixth pivot link 132*b* to the inner claw 142*c*. In one or more scenarios, a pivot member 138*a* may pivotably couple the sixth pivot link 132*b* to the outer claw 142*d*. In one or more scenarios, a pivot member 138*d* may pivotably couple the fourth pivot joint link 104*b* to the outer claw 142*d*. The pivot member 138 may allow the respective pivot joint link and/or links to pivot around the respective pivot member 138. The pivot member 138 may include a head configured to be rotated via a screwdriver, wrench, or other fastening tool known to one of ordinary skill in the art; an unthreaded portion configured to allow the respective pivot link to rotate about the pivot member 138; and a threaded portion configured to be fastened into a threaded portion of the respective claw. In some scenarios, one or more threaded portions may be included within the pivot link support portion 130 of each claw.

In one or more scenarios, the open position locking portion 106 includes a locking tab 302 that protrudes in the longitudinal direction L1 of the device 100 towards the handle mechanism. The locking tab 302 may be a rigid lip structure extending from a notched portion 106*a*. In one or more scenarios, the closed position locking portion 106 includes a locking tab 304 that protrudes in the longitudinal direction L1 of the device away from the handle mechanism. The locking tab 304 may be a rigid lip structure extending from a notched portion 106*b*. The notched portions 106*a* and 106*b* may each be configured to receive at least a portion of the key portion 110. In one or more scenarios, at least a portion of the key portion 110 is configured to fit within the notched portions 106*a* and 106*b* of the locking tabs 302 and 304. In some scenarios, the open position locking portion 106 and the closed position locking portion 108 may be two separate components each attached to the central claw 140. In other scenarios, the open position locking portion 106 and the closed position locking portion 108 may be one singular component that is attached to the central claw 140. The locking tabs 304 and 304 may be configured in a variety of shapes, sizes, and/or dimensions.

In one or more embodiments, to transition the device 100 from a closed position to an open position, a user may pull the key portion 110 out of the notched portion 106*b* of the locking tab 304, pull and/or push the key portion 110 towards the open position locking portion 106, such as in the direction of 306, and insert the key portion 110 into the notched portion 106*a* of the locking tab 302. As the key portion 110 is moved towards the open position locking portion 106, the claws pivot about the pivot members and the claws expand away from one another. In the open position, the claws are in an expanded form. The claws may be parallel with one another and form a retrieval portion 120 between each set of claws. For example, the inner claw 142*c* and the outer claw 142*d* form a retrieval portion 120, and the inner claw 142*b* and the outer claw 142*a* from another retrieval portion 120.

Figure 2:
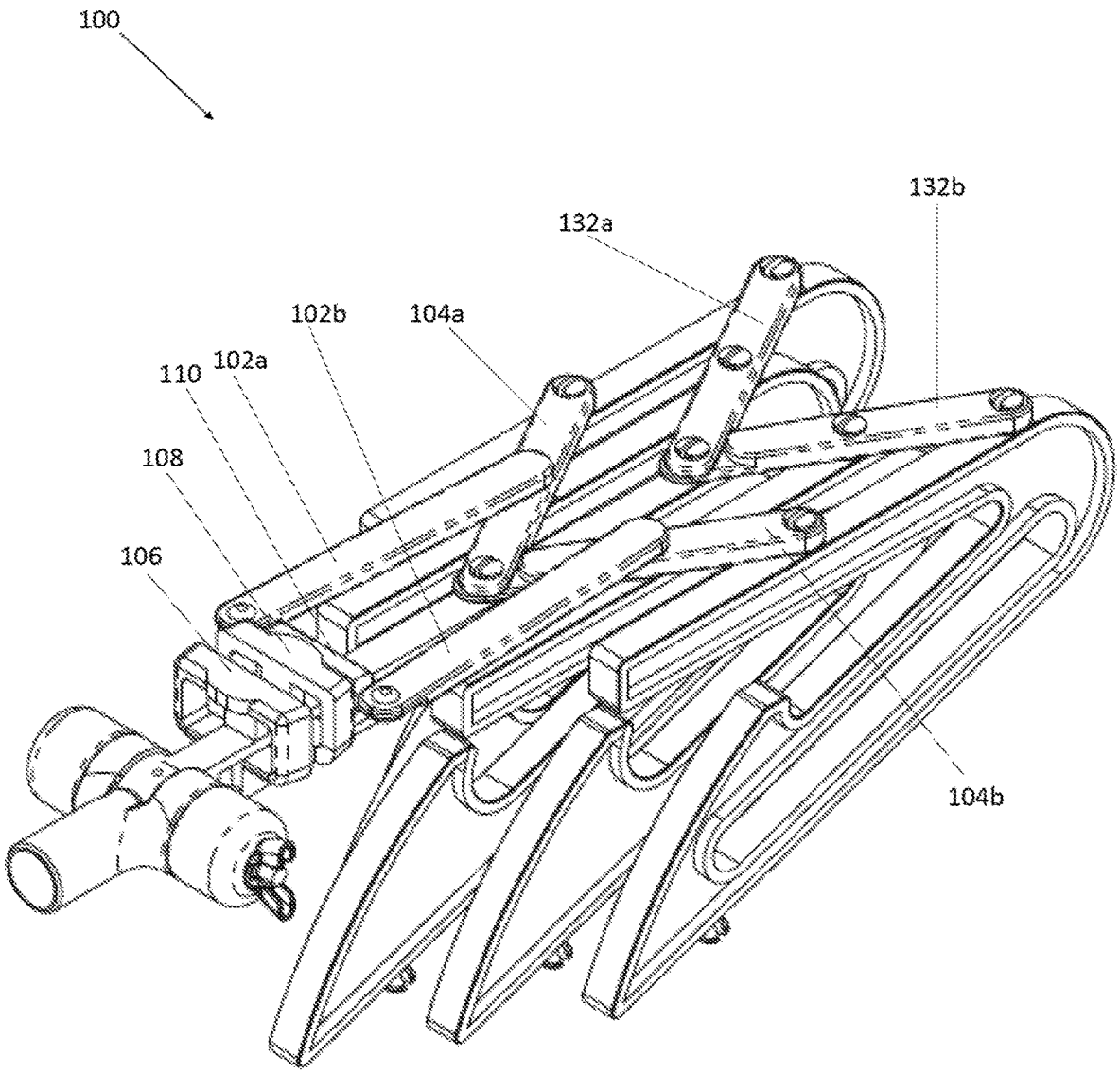
FIG. 2 illustrates an isometric view of the golf ball retrieval device in a closed position.
Figure 3B:
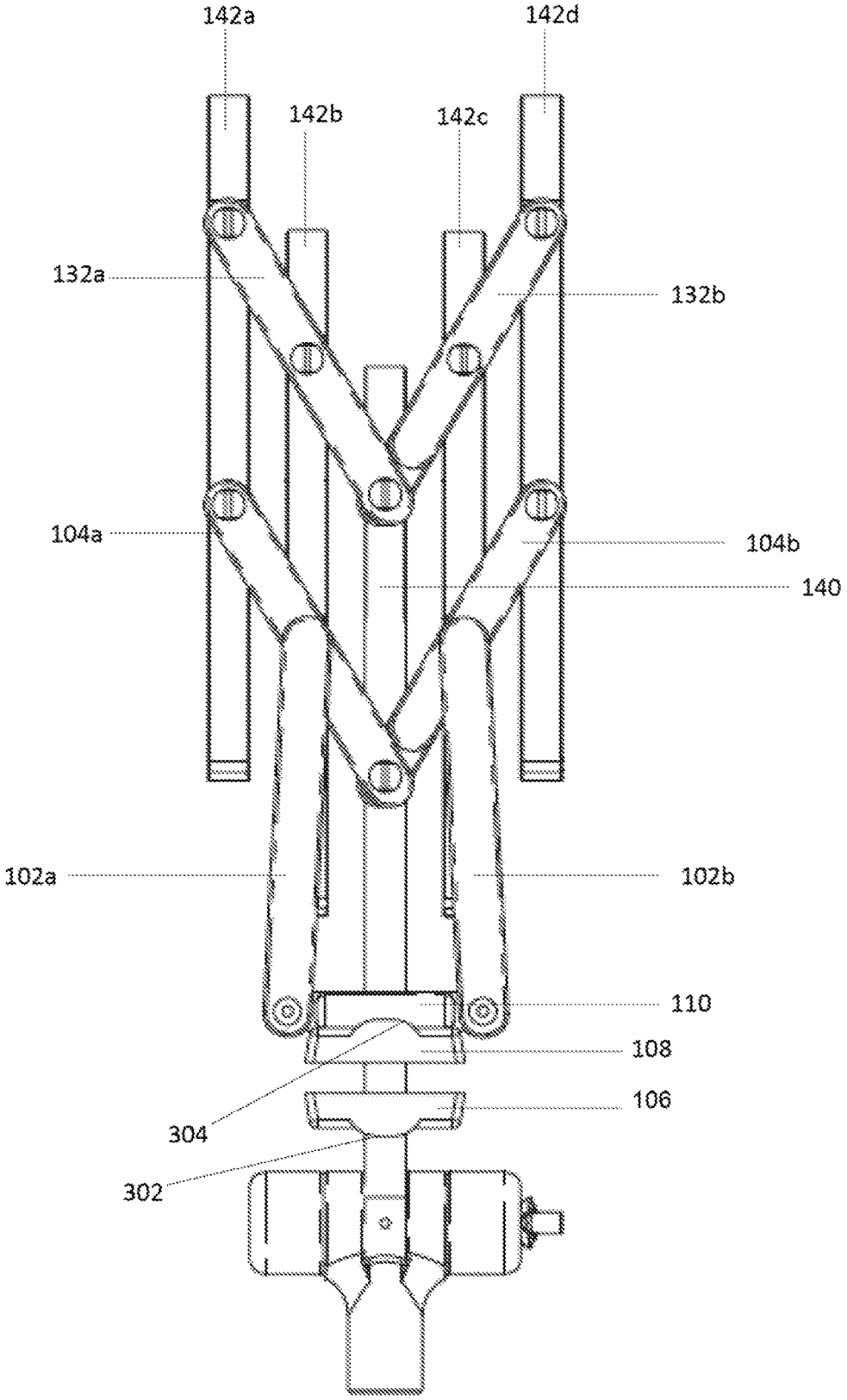
FIG. 3B illustrates a top view of the golf ball retrieval device in a closed position.

FIG. 2 illustrates an isometric view of the device 100 in a closed position. FIG. 3B illustrates a top view of the device 100 in a closed position.

In one or more scenarios, to transition the device 100 from an open position to a closed position, a user may pull the key portion 110 out of the notched portion 106*a* of the locking tab 302, pull and/or push the key portion 110 towards the closed position locking portion 108, such as in the direction of 308, and insert the key portion 110 into the notched portion 106*b* of the locking tab 304. As the key portion 110 is moved towards the closed position locking portion 108, the claws pivot about the pivot members and the claws mover towards one another. In one or more scenarios, the claws are in a compressed form in the closed position. In the closed position, the claws may be arranged in a staggered manner, such that the third pivot link 104*a* and the fourth pivot link 104*b* are arranged in a V-shape, and/or the fifth pivot link 132*a* and the sixth pivot link 132*b* are arranged in a V-shape. In some scenarios, in the closed position, the side surfaces of the claws may contact one another in the compressed form. In other scenarios, in the closed position, the claws may be positioned near one another such that the claws are in a compressed form and the side surfaces of the claws do not contact one another.

Figure 4A:
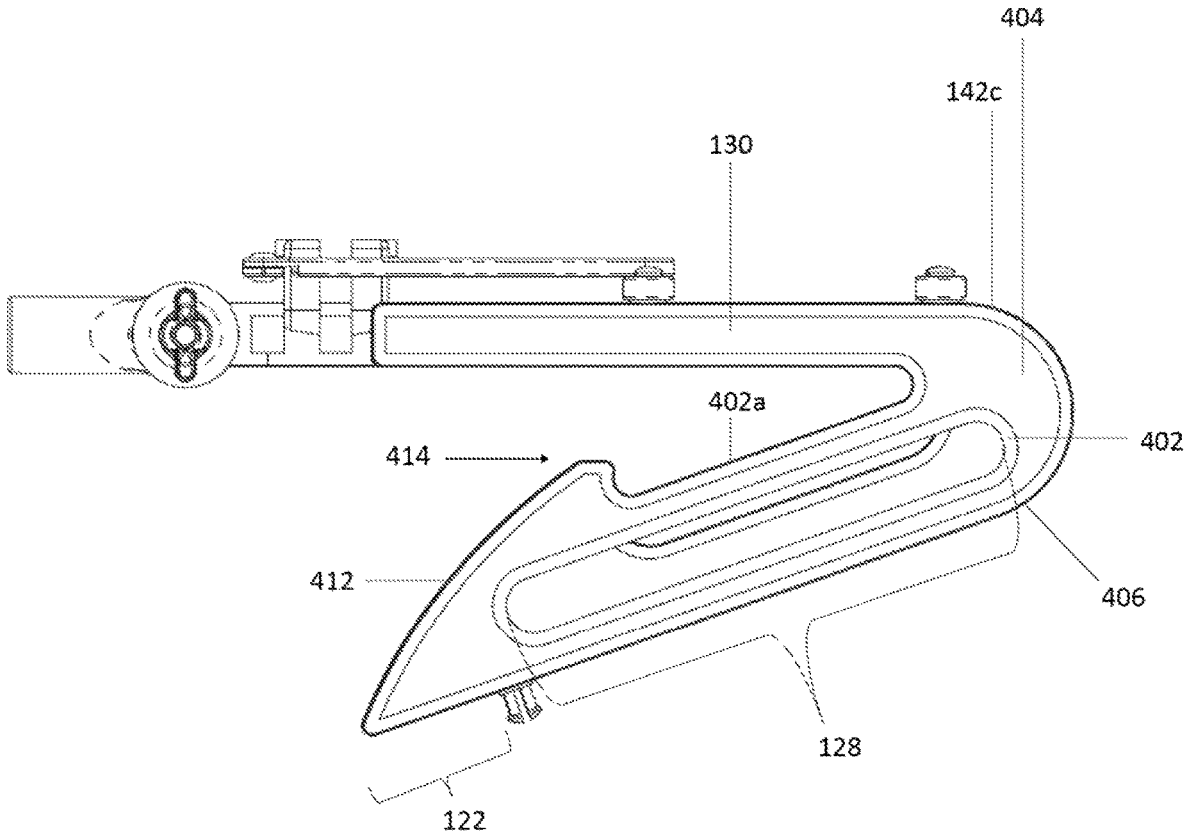
FIG. 4A illustrates a side view of an outer claw of the golf ball retrieval device.
Figure 4B:
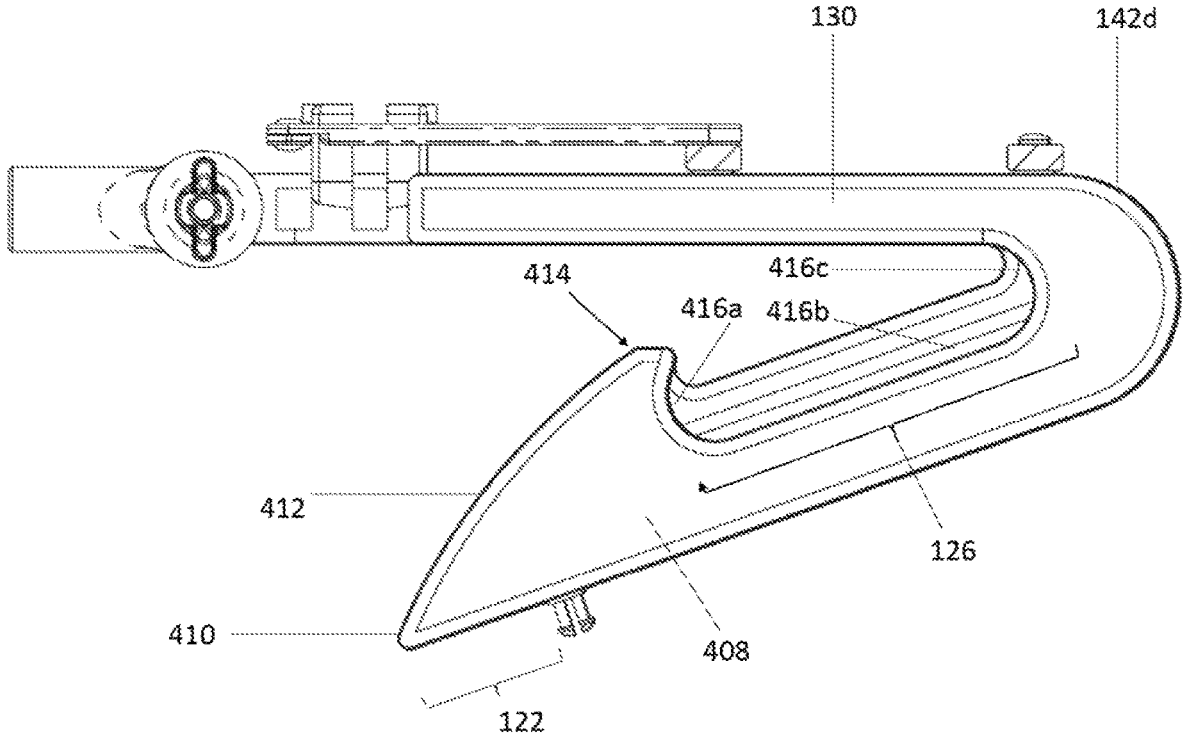
FIG. 4B illustrates a side view with the outer claw of FIG. 4A removed to show details of an inner claw of the golf ball retrieval device.

FIG. 4A illustrates a side view of an outer claw, such as outer claw 142*a* or 142*d*, of the device 100. FIG. 4B illustrates a side view with the outer claw removed to show details of an inner claw, such as inner claw 142*b* or 142*c*, of the device 100.

In one or more scenarios, the claws may each be a V-shaped rigid structure. The claws may be formed in one or more other rigid shaped structures that can efficiently trap a ball between two adjacent claws. The outer claws 142*a* and 142*d* each include a ball holding track 128. In one or more scenarios, the ball holding track 128 may include a rim 402 that protrudes away from the outer surface 404 of the outer claw and protrudes from the inner surface 406 of the outer claw towards the central claw 140. The ball holding track 128 may define an area on the inner surface 406 of the claw in which material is removed, thereby creating a space in the sidewall of the claw. The ball holding track 128 includes a space in which a portion of a ball may be positioned. The outer claws 142*a* and 142*d* each include a jagged portion 414 having similar features to the jagged portion 414 of the inner claws 142*b* and 142*c*.

In one or more other scenarios, the ball holding track 128 may include the rim 402 that is positioned on the inner surface 406 and that protrudes towards the central claw 140. The ball holding track 128 may define an area on the inner surface 406 of the claw in which there is no space in the sidewall of the claw, rather, the rim 402 protrudes far enough from the inner surface 406 towards an adjacent inner claw to hold one or more balls.

In one or more scenarios, the inner claws 142*b* and 142*c* include a ball holding portion 126. The ball holding portion 126 may be a C-shaped surface extending from a jagged portion 414 of an inner claw to the pivot link support portion 130. The ball holding portion 126 may include a first curved portion 416*a*, a flat portion 416*b*, and a second curved portion 416*c*, in which the first curved portion 416*a* is disposed on one end of the flat portion 416*b* and the second curved portion 416*c* is disposed on the opposing end of the flat portion 416*b*. Two adjacent ball holding portion, such as ball holding portion 126 and ball holding portion 126*a*, may be spaced far enough apart such that a portion of a ball may rest in between the two adjacent ball holding portions. For example, a portion of the ball may rest in between two flat portions 416*b*; two first curved portions 416*a*; two second curved portions 416*c*; or one or more combinations of the aforementioned. Two adjacent ball holding portions may be configured to hold one or more balls. For example, the ball holding portion 126 and the ball holding portion 126*a* may hold 1 to 7 golf balls.

In one or more scenarios, as the device 100 or 500 is dragged, a ball enters the ball retrieval portion 120 and at least a portion of the ball travels in between two adjacent angular portions 412. The ball may travel along the adjacent angular portions 412 until the ball traverses the adjacent jagged portions 414 and falls towards the adjacent ball holding portions, such as ball holding portion 126 and ball holding portion 126*a*. A portion of a ball may rest in between the two adjacent ball holding portions.

For the scenarios in which a ball travels along an angular portion 412 of an inner claw, such as inner claw 142*c*, and an angular portion 412 of an outer claw, such as outer claw 142*d*, the ball may traverse the jagged portions 414 and a portion of the ball may fall in between the ball holding portion 126 and the ball holding track 128. The ball holding track 128 is configured to prevent one or more balls from exiting a respective side of the device 100, such as side 144*a* or side 144*b*. The top rail 402*a* of the rim 402 is configured to hold a ball in the ball holding portion 126. For example, the ball holding track 128 of the outer claw 142*d* may prevent a ball from exiting side 144*a*, thereby retaining the ball within the ball holding portion 126.

In one or more embodiments, the central claw 140 includes one or more features of the inner claws 142*b* and 142*c*. Moreover, the length of the pivot link support portion 130*a* of the central claw 140 is greater than the length of the pivot link support portion 130 of the other claws. In one or more embodiments, the pivot link support portion 130*a* of the central claw 140 is coupled to the handle mechanism. Portions of the folding joint 112 are configured to fit on at least two sides of the pivot link support portion 130*a* of the central claw 140. The tensioner portions 118*a* and 118*b* may be positioned on each of the outermost sides of the folding joint 112.

In one or more embodiments, the device 100 includes the central claw 140 and the outer claws 142*a* and 142*b*, and does not include the inner claws 142*b* and 142*c*.

In one or more embodiments, the claws each have a tine portion 122 on an end of the claw. The tine portion 122 may be a rigid triangular structure including a pointed end 410 and an angular portion 412. The pointed end 410 may be configured to rake a surface. The angular portion 412 may provide an additional portion of the claw in which to rake the surface. In some scenarios, the angular portion 412 may have an arced shape surface or a flat planar surface. The tine portion 122 of each claw may form a rake. For example, a user may position the tine portions 122 in a sand trap and drag the device 100 in a direction to rake the sand trap. The user can also rotate the folding joint 112 to adjust the angle and/or position in which tine portions 122 contact a ground surface, such as a sand trap.

Figure 5:
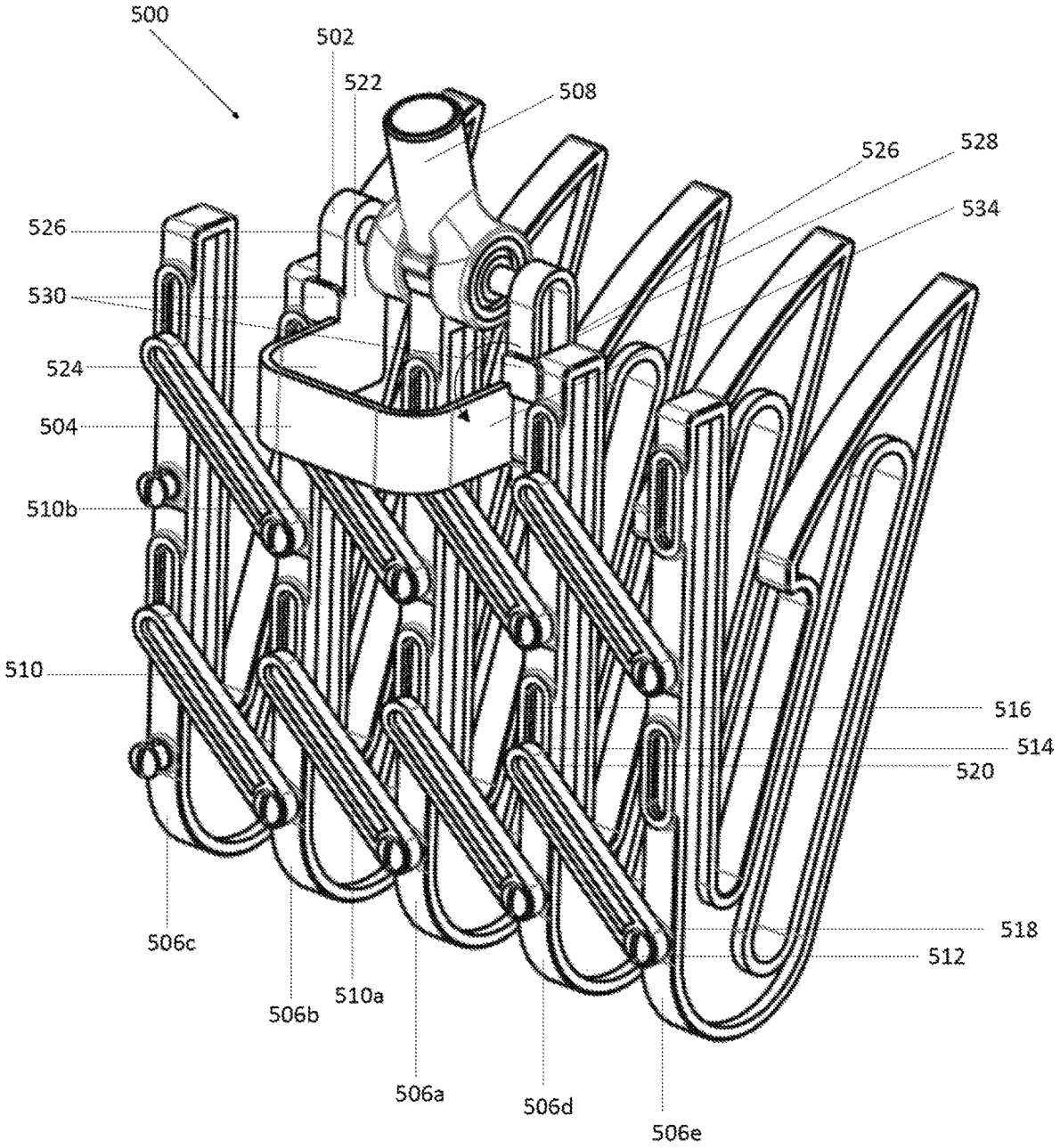
FIG. 5 illustrates an isometric view of a second example of the golf ball retrieval device in a locked and open position.
Figure 6:
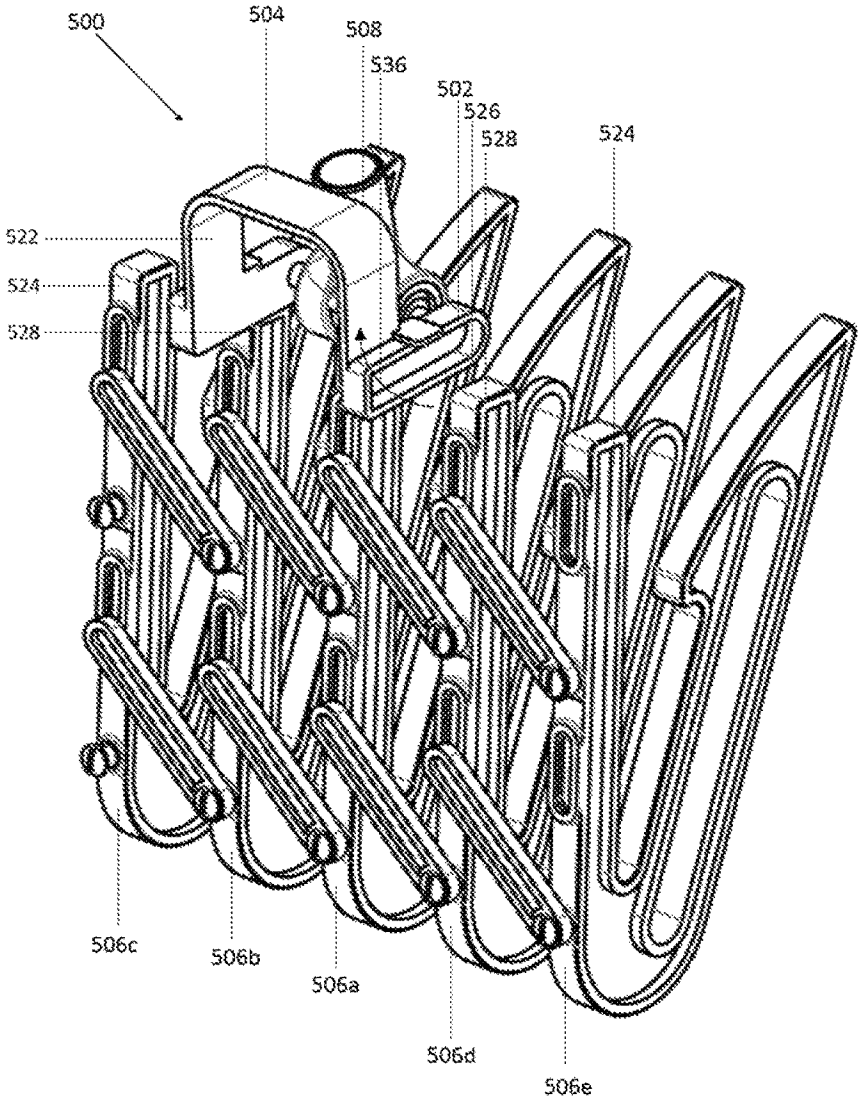
FIG. 6 illustrates an isometric view of the golf ball retrieval device in an unlocked and open position.
Figure 7:
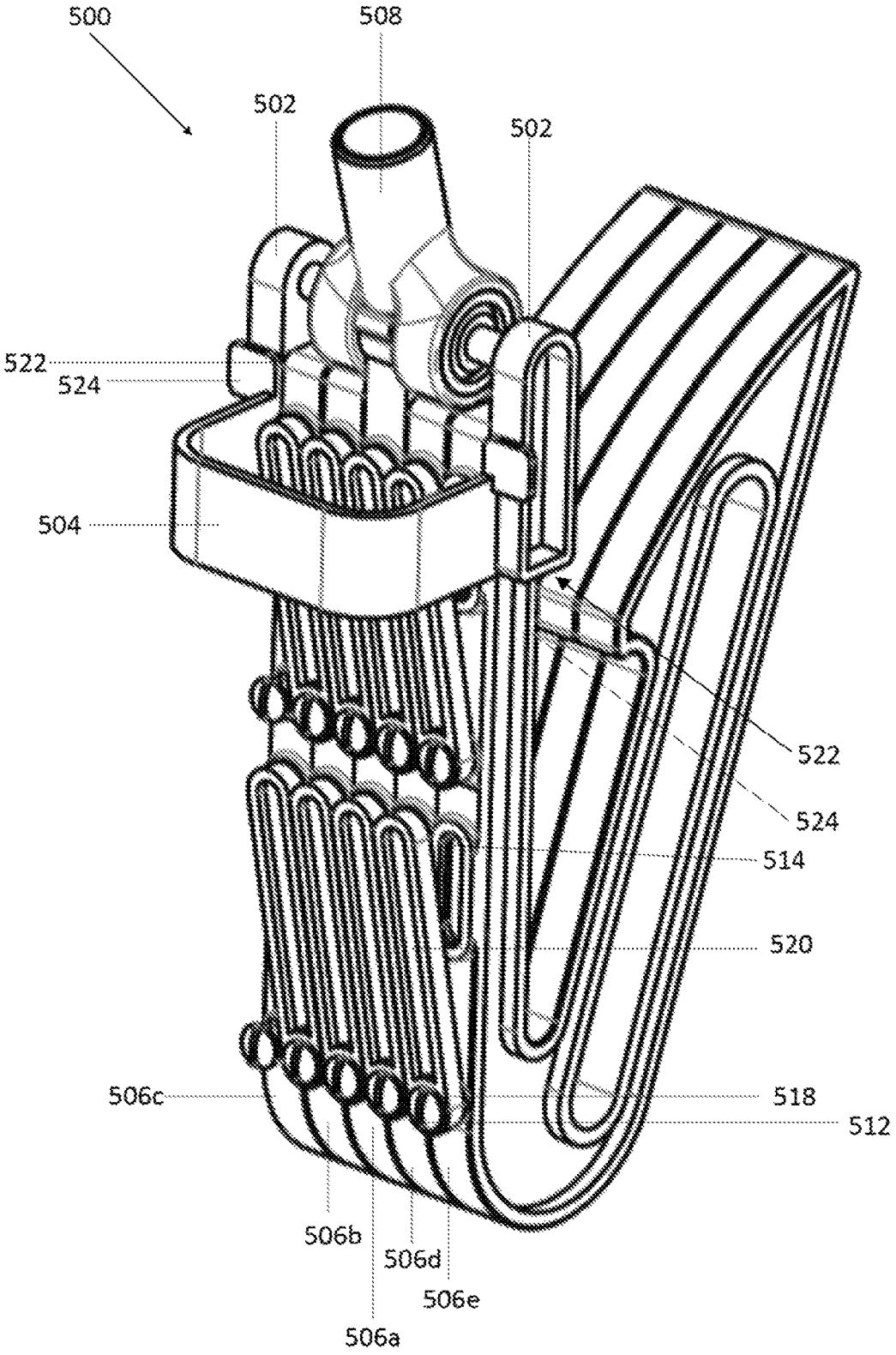
FIG. 7 illustrates an isometric view of the golf ball retrieval device in a locked and closed position.

FIG. 5 illustrates an isometric view of a second example of the golf ball retrieval device 500 (hereinafter "device 500") in a locked and open position. FIG. 6 illustrates an isometric view of the device 500 in an unlocked and open position. FIG. 7 illustrates an isometric view of the device 500 in a locked and closed position.

The device 500 includes a handle mechanism, a locking mechanism 502, and a retrieval mechanism. The handle mechanism includes a folding joint 508 that is configured to receive and fasten an elongated tubular handle to the device 500.

In one or more scenarios, the retrieval mechanism includes a plurality of claws. The plurality of claws may include a central claw 506*a* and secondary claws, such as claws 506*b*, 506*c*, 506*d*, and 506*e*, disposed on either side and in parallel with the central claw 506*a*. The central claw 506*a* may be pivotably coupled to the folding joint 508 and may pivot along a horizontal axis relative to the folding joint 508. The secondary claws may be pivotably coupled to one another and/or to the central claw 506*a* by one or more pivot links 510. The pivot links 510 facilitate a pivot operation whereby the secondary claws pivot to an expanded form in which the central claw and secondary claws are spaced apart, such as in the open position. The pivot links 510 may allow the secondary claws to pivot to a compressed form in which the central claw and secondary claws are compressed together, such as in the closed position.

In one or more scenarios, the claws 506*c* and 506*e* are similar to the outer claws 142*a* and 142*d*, which include a ball holding track 128. The claws 506*a* and 506*b* may be pivotably coupled together by the pivot links 510*a* and 510*b*. A pivot link 510 may be a rigid elongated linking member having a first end 518 opposed to a second end 520. The first end 518 may connect to a claw, such as claw 506*e*, by a first pivot member 512 and may rotate about a longitudinal axis of the first pivot member 512. The first pivot member 512 may include one or more features of the pivot member 138. A second pivot member 514 may protrude from the second end 520 of the pivot link 510 towards an adjacent claw, such as claw 506*d*. The second pivot member 514 may be an elongated rigid structure configured to be disposed within a slot 516 of the adjacent claw. In one or more scenarios, an adjacent claw may be connected by two or more pivot links 510. For these instances in which the device 500 is transferring from a collapsed form to an expanded form, the first end 512 of a pivot link 510 may rotate simultaneously as the second pivot member 514 of the pivot link 510 slides downward within the slot 516. For the instances in which the device 500 is transferring from the expanded form to the collapsed form, the first end 512 of the pivot link 510 may rotate simultaneously as the second pivot member 514 slide upwards within the slot 516. In one or more other scenarios, the claws of the device 500 include one or more features and/or arrangements of the claws of the device 100 described above.

The locking mechanism 502 may be attached to the folding joint 508, the central claw 506*a*, or both. The locking mechanism 502 may include a handle portion 504. In some scenarios, the handle portion 504 may be a rigid structure configured to rotate about the folding joint 508. The handle portion 504 may be formed in a U-shape. When the claws are to be returned to a collapsed form, the handle portion 504 and the locking mechanism 502 may pivot downwards in a direction 534. When positioned in this way, the interior surfaces 522 of the locking mechanism 502 may fit over a portion of outer surfaces 524 the outermost claws 506*c* and 506*e* of the retrieval mechanism. The claws are returned in a locked and closed position, as shown in FIG. 7. When the handle portion 504 and the locking mechanism 502 are pivoted upwards in a direction 536, the claws transition from the collapsed form to an expanded form, thereby moving the claws into an unlocked and open position. While the claws are in an expanded form, the handle portion 504 and the locking mechanism 502 may pivot downwards in the direction 534. This will result in the exterior surfaces 526 of the locking mechanism 502 fitting over a portion of the interior surfaces 528 of claws 506*b* and 506*d* adjacent to the central claw 506*a*. Consequently the claws will be returned in a locked and open position, as shown in FIG. 5. In some scenarios, the handle portion 504 includes one or more stopping members 530 configured to overlap a portion of claws 506*b* and 506*d* when the device 500 is in the locked and open position. A stopping member 530 may be a rigid structure formed on an outer surface of the handle portion 504. A portion of the stopping member 530 is configured to overlap a claw extends in the direction of the outermost claw. For instance, the portion of the stopping member 530 configured to overlap a portion of claw 506*b* extends outwards towards claw 506*c*. In one or more scenarios, a spring may be included in the handle portion 504. The spring may be configured to bias the locking mechanism 502 in the downwards direction 534 in the locked and open position. A user may pull the locking mechanism 502 in the upwards direction 536 away from the claws against the bias of the spring, and the claws may pivot away from one another to the expanded form.

In one or more scenarios, the device 500 includes the central claw 506*a* and the outer claws 506*c* and 506*e* and does not include the inner claws adjacent to the central claw 506*a*.

In one or more scenarios, the device 100 and the device 500 may be comprised of a variety of materials, including but not limited to wood; metal; acrylonitrile butadiene styrene; polymer plastics; synthetic polymers such as polyvinyl alcohol; nylon; high-density polyethylene; polyethylene terephthalate; wood filament; metal filament; and carbon fiber filament.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A ball retrieval device, the device comprising:

a plurality of claws disposed adjacent to one another and aligned in a first direction, each of the plurality of claws including a coupling portion to which at least one pivot member is fixed;

a plurality of elongated rigid link members, each extending transversely between two or more of the plurality of claws and arranged to pivot on two or more of the pivot members, whereby the plurality of claws are movable relative to one another between a collapsed configuration and an expanded configuration; and a locking mechanism which is movable between at least a first position and a second position, the locking mechanism configured to secure the plurality of claws in the collapsed configuration when the locking mechanism in the first position, and to secure the plurality of claws in the expanded configuration when the locking mechanism is in the second position;

wherein the plurality of claws in the collapsed configuration are spaced apart from each other by a first distance, and in the expanded configuration are spaced apart from each other a second distance which is greater than the first distance.

2. The ball retrieval device of claim 1, further comprising a handle mechanism including a handle receiver which is configured to receive an elongated handle.

3. The ball retrieval device of claim 1, wherein one or more of the plurality of claws includes a ball holding track structure which extends along an elongated length of the claw and is configured for retaining one or more golf balls therein.

4. The ball retrieval device according to claim 3, wherein the second distance is configured to allow a golf ball to be snugly received between adjacent ones of the plurality of claws.

5. The ball retrieval device according to claim 1, wherein each of the plurality of elongated rigid link members is arranged to pivot on at least one pivot member of a first claw of the plurality of claws, the first claw disposed centrally with respect to the plurality of claws.

6. The ball retrieval device according to claim 5, wherein each of the plurality of elongated rigid link members is arranged to pivot on pivot member associated with at least two additional claws other than the first claw.

7. The ball retrieval device according to claim 5, further comprising a plurality of elongated control link members, each pivotally coupled at a first end to one of the elongated rigid link members, and at a second end to a key portion of the locking mechanism.

8. The ball retrieval device according to claim 1, wherein each of the plurality of elongated link members is arranged to pivot on only two of the plurality of claws.

9. The ball retrieval device according to claim 1, wherein each of the plurality of claws comprise a tine portion on an end of the respective claw.

10. A ball retrieval device, the device comprising:

a plurality of claws disposed adjacent to one another and aligned in a first direction, each of the plurality of claws including a coupling portion to which at least one pivot member is fixed;

a plurality of elongated rigid link members, each extending transversely between two or more of the plurality of claws and arranged to pivot on two or more of the pivot members, whereby the plurality of claws are movable relative to one another between a collapsed configuration and an expanded configuration; and a locking mechanism which is movable between at least a first position and a second position, the locking mechanism configured to secure the plurality of claws in the collapsed configuration when the locking mechanism in the first position, and to secure the plurality of claws in the expanded configuration when the locking mechanism is in the second position;

wherein the plurality of claws in the collapsed configuration are spaced apart from each other by a first distance, and in the expanded configuration are spaced apart from each other a second distance which is greater than the first distance, and wherein each of the plurality of elongated rigid link members is arranged to pivot on at least one pivot member of a first claw of the plurality of claws, the first claw disposed centrally with respect to the plurality of claws.

11. The ball retrieval device according to claim 10, wherein each of the plurality of elongated rigid link members is arranged to pivot on pivot member associated with at least two additional claws other than the first claw.

12. The ball retrieval device according to claim 10, further comprising a plurality of elongated control link members, each pivotally coupled at a first end to one of the elongated rigid link members, and at a second end to a key portion of the locking mechanism.

13. The ball retrieval device according to claim 10, wherein each of the plurality of claws comprise a tine portion on an end of the respective claw.

14. A ball retrieval device, the device comprising:

a plurality of claws disposed adjacent to one another and aligned in a first direction, each of the plurality of claws including a coupling portion to which at least one pivot member is fixed;

a plurality of elongated rigid link members, each extending transversely between two or more of the plurality of claws and arranged to pivot on two or more of the pivot members, whereby the plurality of claws are movable relative to one another between a collapsed configuration and an expanded configuration; and a locking mechanism which is movable between at least a first position and a second position, the locking mechanism configured to secure the plurality of claws in the collapsed configuration when the locking mechanism in the first position, and to secure the plurality of claws in the expanded configuration when the locking mechanism is in the second position;

wherein the plurality of claws in the collapsed configuration are spaced apart from each other by a first distance, and in the expanded configuration are spaced apart from each other a second distance which is greater than the first distance, and wherein each of the plurality of elongated link members is arranged to pivot on only two of the plurality of claws.

15. The ball retrieval device according to claim 14, wherein each of the plurality of claws comprise a tine portion on an end of the respective claw.

* * * * *